US005561435A

United States Patent [19]

Nalbandian et al.

[11] Patent Number: 5,561,435

[45] Date of Patent: Oct. 1, 1996

[54] PLANAR LOWER COST MULTILAYER DUAL-BAND MICROSTRIP ANTENNA

[75] Inventors: Vahakn Nalbandian, Ocean City, N.J.; Choon Sae Lee, Dallas, Tex.; Felix Schwering, Eatontown, N.J.

[73] Assignee: The United States of America as represented by the Secretary of the Army, Washington, D.C.

[21] Appl. No.: 385,615

[22] Filed: Feb. 9, 1995

[51] Int. Cl.[6] ..... H01A 1/38

[52] U.S. Cl. ..... 343/700 MS

[58] Field of Search ..... 343/700 MS, 849, 343/829, 830, 853, 818

[56] References Cited

U.S. PATENT DOCUMENTS

| | | | |
|---|---|---|---|
| 4,218,682 | 8/1990 | Yu | 343/830 X |
| 4,660,048 | 4/1987 | Doyle | 343/700 MS |
| 4,893,400 | 6/1989 | Tsao et al. | 343/829 X |
| 4,914,445 | 4/1990 | Shoemaker | 343/700 MS |
| 4,924,236 | 5/1990 | Schuss et al. | 343/700 MS |
| 4,929,959 | 5/1990 | Sorbello et al. | 343/700 MS |
| 4,987,421 | 1/1991 | Sunahara et al. | 343/700 MS |
| 5,006,858 | 4/1991 | Shirosaka | 343/700 MS |
| 5,187,490 | 2/1993 | Ohta et al. | 343/700 MS |
| 5,319,378 | 6/1994 | Nalbandian et al. | 343/700 |
| 5,400,039 | 3/1995 | Araki et al. | 343/700 MS |

FOREIGN PATENT DOCUMENTS

| | | | |
|---|---|---|---|
| 0016402 | 1/1984 | Japan | 343/700 MS |

*Primary Examiner*—Donald T. Hajec
*Assistant Examiner*—Tho Phan
*Attorney, Agent, or Firm*—Michael Zelenka; William H. Anderson

[57] ABSTRACT

A planar dual band antenna comprising three superimposed dielectric layers, a ground plane on one external surface, a conductive patch on the other and parallel conductive strips at the interface of dielectric layers that is closer to the patch. The dielectric constant of the middle layer is different from that of the two other layers.

6 Claims, 2 Drawing Sheets

PLANAR LOWER COST MULTILAYER DUAL-BAND MICROSTRIP ANTENNA

GOVERNMENT INTEREST

The invention described herein may be manufactured, used, and licensed by or for the Government for governmental purposes without the payment to us of any royalties thereon.

FIELD OF THE INVENTION

This invention relates to the field of antennas.

BACKGROUND OF THE INVENTION

Many military and commercial communication systems need compact low cost antennas such as aircraft and global positioning systems.

Microstrip antennas have been widely used instead of conventional antennas because they are relatively light in weight, low in cost, and have a low profile. Unfortunately, however, their bandwidth is too narrow for many applications, but there are some applications such as global positioning systems that require only a few distinct frequency bands rather than a continuous spectrum. The generally planar dual band antennas presently known have features perpendicular to the main plane of the antenna that are expensive to manufacture. These antennas have a ground plane on one side of a dielectric layer and patches of conductive material on the other.

SUMMARY OF THE INVENTION

In accordance with this invention, a dual band antenna is comprised of a conductive sheet having a first dielectric layer between it and a second dielectric layer, parallel spaced conductive strips on the side of said second dielectric layer that is remote from said conductive sheet, a third dielectric layer covering said second dielectric layer and said conductive strips and a conductive patch on the side of third dielectric layer that is remote from said second dielectric layer. A layer of bonding film is on either side of the second dielectric layer. Excitation is achieved by extending the central conductor of an SMA probe through the conductive sheet and all of the dielectric layers up to the conductive patch at a point between the conductive strips and connecting the shield of the probe to the conductive sheet.

DETAILED DESCRIPTION OF THE INVENTION

Figure 1:
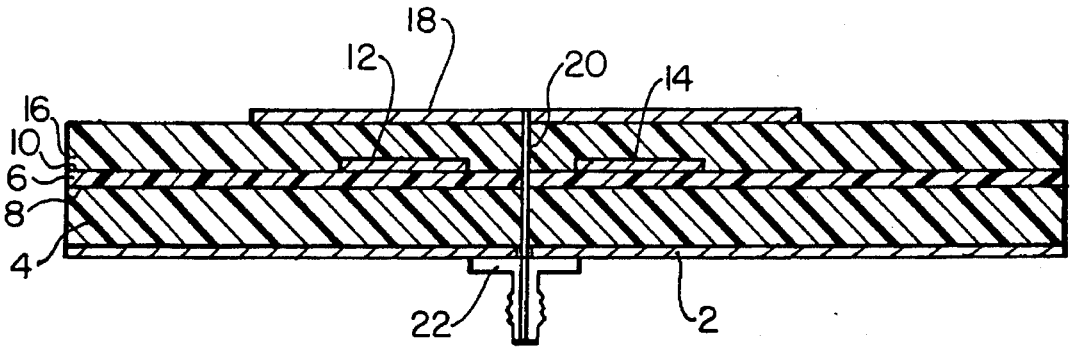
FIG. 1 is a cross section of the dual band antenna of this invention taken in a plane perpendicular to the conductive strips.

Reference is made to the cross sectional view of the antenna shown in FIG. 1. A sheet 2 is conductive and covers the entire bottom plane of the antenna. A first dielectric layer 4 is located between the conductive sheet 2 and a second dielectric layer 6. Usually, bonding films 8 and 10 are on either side of the dielectric layer 6. As will be seen in FIG. 2, conductive strips 12 and 14 that are on the second dielectric layer 6, are parallel. A third dielectric layer 16 lies between the second dielectric layer 6 the strips 12 and 14 and a conductive patch 18. Thus, the dielectric layers 4, 6 and 16 form a striated structure having two external surfaces with the sheet 2 on one surface and the patch 18 on the other.

Figure 2:
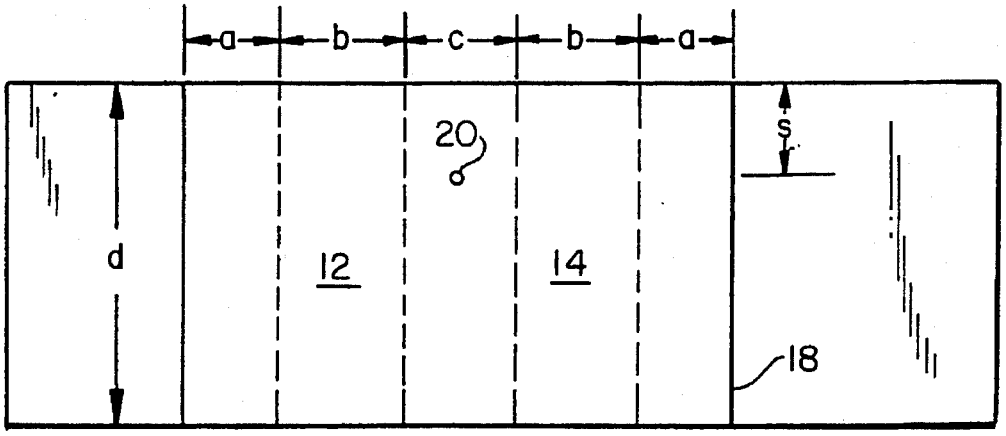
FIG. 2 is a top view of FIG. 1.

Excitation of the antenna is achieved by extending the central conductor 20 of an SMA probe 22 through the conductive sheet 2 and the dielectric layers 4, 6 and 16 to the conductive patch 18 at a point midway between the conductive strips 12 and 14, and, as can be seen in FIG. 2 at a distance S from their ends. In the lateral direction, the conductive patch 18 extends beyond the outer or remote edges of the conductive strips 12 and 14. In the direction parallel to the strips, the width of the conductive patch typically will be equal to the length of the strips. The dielectric layer 6 is the thinnest and the dielectric layer 4 is preferably thicker than the dielectric layer 16. The total thickness of all the layers is much smaller than any radiated wavelength.

FIG. 2 is a top view of FIG. 1 showing the width of the conductive strips 12 and 14 and other dimensions by lower case letters. The frequencies of the upper and lower band are determined by the dimension d of the conductive patch and by the dielectric constants of the three dielectric layers. While the dielectric constant of layers 4 and 16 in effect determine the frequency of the upper band, the dielectric constant of layer 6, which is assumed to be larger than that of the two other layers, has a determining influence on the frequency of the lower band. The central conductor 20 is connected at a distance s along this dimension at which the impedance of the antenna at the higher frequency matches the impedance of the probe 22, and the separation c between the conductive strips 12 and 14 is such as to provide an impedance match at the lower frequency as well. The difference between the upper and lower frequencies is determined by the thickness of the dielectric layers and their respective dielectric constants. It is important, however, that the dielectric constant of the, second dielectric layer 6 be different from the dielectric constant of the first dielectric layer 2 and the dielectric constant of the third dielectric layer 16.

Those skilled in the art know that for typical multi-layer dual-band antennas, the layer thicknesses are assumed to be much smaller than the wavelength and a cavity model is used for analyzing the antenna characteristics. For this analysis, the antenna structure is considered to be a leaky resonating cavity where the open-ended edges are considered to be blocked by a perfect magnetic conductor. In conventional antennas, therefore, there are multiple resonant frequencies that are regularly separated. However, with the structure of the present invention, these resonant frequencies can be altered by varying patch sizes, layer thicknesses and the dielectric constants of the substrate. The unique feature of the present invention is the strip patches that are placed on the interface of the two different dielectric materials. These patches divide the cavity roughly into two regions. As stated earlier, the feed is located such that the radiating edges are perpendicular to the inner strips and, therefore, two types of resonance result. Each resonance indicates a high field excitation in the corresponding region. The dielectric constant in each region critically determines its corresponding resonant frequency. Accordingly, in one embodiment of the invention, two different dielectric materials are mixed in the bottom layer to give an effective dielectric constant between those of homogeneous mediums. As those skilled in the art readily know, commercially available dielectric substrates are only available in a limited number of dielectric constants and therefore, the mixing of two different substrate materials will achieve the desired results.

With such a configuration, the present invention provides an antenna which is easy to fabricate and can be easily mass produced by using printed-circuit technology. The two resonant frequencies can be placed as closely as desired and the relative bandwidths at those two frequencies can be adjusted. Further, the radiation patterns at each resonant frequency will not be degraded by the dual-frequency operation.

For purpose of analysis, the resonating cavity of the present invention is divided into seven subregions. In each subregion, fields may be expressed in terms of the modal fields that satisfy the appropriate boundary conditions. The resonant frequencies and field distributions are derived by using mode-matching techniques at the interfaces between the subregions. Since the problem is symmetric, only a half of the structure should be considered assuming a perfect magnetic conductor at a the symmetry plane. Given this type of analysis, those skilled in the art will be able to arrive at number of specific application configurations for the present invention.

The impedance matching at both resonant frequencies is achieved by moving the middle layer strips. Shifting the strips under the radiation patch does not change the resonant frequencies much but increases the resonant resistance at one frequency while decreasing that at the other frequency. The bandwidth at the higher resonant frequency is larger than that at the lower frequency when the layer thicknesses above and below the middle strips are the same. Therefore, to compensate for such a difference, the layer below the middle strips should be thicker than the upper layer.

Figure 3:
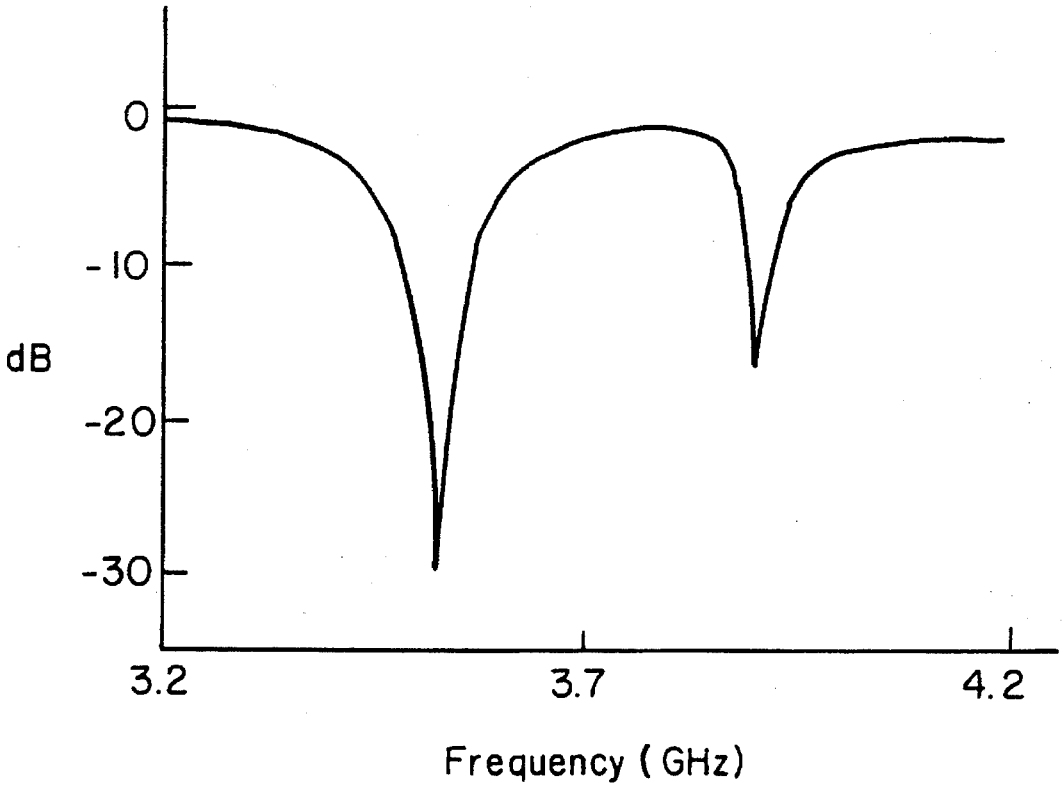
FIG. 3 is a graph illustrating the impedance response of an antenna of the invention having particular parameters.

By way of example, an antenna constructed with the dimensions a=0.7 cm, b=1.0 cm, c=0.6 cm, d=2.5 cm, s=0.65 cm, the thickness of the dielectric layers 4, 6, 16 being respectively 31 mils, 10 mils, and 20 mils, the relative dielectric constants of these layers being 2.2, 6.2 and 2.2 and the thicknesses of the bonding films 8 and 10 being 1.5 mils radiates frequencies of 3.52 GHz and 3.9 GHz as shown in FIG. 3 which is a plot of return loss vs frequency.

Although the present invention has only been described in terms of one embodiment, those skilled in the art will be able to devise specific applications for the present invention. Therefore, the inventors herein do not wish to be limited by the present disclosure, but only by the following claims.

What we claim is:

1. A dual frequency antenna comprising:

a metallic sheet;

a first layer of dielectric material;

a first bonding film on said first layer;

a second layer of dielectric material on said first bonding film;

a second bonding film on said second layer of dielectric material;

first and second conductive strips on said second bonding film, said first and second conductive strips being spaced so as to not contact each other and being disposed in a same plane;

a third layer of dielectric material on said second bonding film and said first and second conductive strips;

a patch of conductive material on said third layer of dielectric material; and a probe having a central conductor and a shield, said probe mounted with its shield in contact with said metallic sheet and its central conductor extending through said sheet, through said first, second, and third dielectric layers and through said first and second bonding films to said patch of conductive material, via a space between said first and second conductive parallel strips; wherein said probe is disposed perpendicular to the plane of the first and second conductive strips such when radiating energy is exposed to the antenna a first resonance above the first and second conductive strips and a second resonance below the first and second conductive strips result.

2. An antenna as set forth in claim 1, wherein the dielectric constant of said second dielectric layer is different from the dielectric constants of said first and third dielectric layers.

3. A dual band antenna as set forth in claim 1, wherein:

said first and second conductive strips have edges which are remote from one another and said patch is wider than a distance between the remote edges of said parallel strips.

4. A dual band antenna as set forth in claim 1, wherein said first dielectric layer is thicker then said third dielectric layer and said second dielectric layer is the thinnest.

5. An antenna comprising:

first, second and third successive layers of dielectric material forming a striated structure having first and second outside surfaces, the first and third successive layers of dielectric material having a dielectric constant which is different from a dielectric constant of the second layer;

a sheet of conductive material on said first outside surface;

a patch of conductive material on said second outside surface;

first and second conductive strips mounted between two of said dielectric layers, said first and second conductive strips being spaced apart and being disposed in a same plane; and a probe having a central conductor and a shield, said probe mounted with its shield in contact with said metallic sheet and its central conductor extending through said sheet, through said first, second, and third dielectric layers to said patch of conductive material, via a space between said first and second conductive parallel strips; wherein said probe is disposed perpendicular to the plane of the first and second conductive strips such when radiating energy is exposed to the antenna a first resonance above the first and second conductive strips and a second resonance below the first and second conductive strips result.

6. A dual frequency microstrip antenna comprising:

a conductive sheet;

a first layer of dielectric material having a first dielectric constant, the first layer of dielectric material disposed over the conductive sheet;

a second layer of dielectric material having a second dielectric constant which is different than the first dielectric constant, the second layer of dielectric material being disposed over the first layer of dielectric material;

first and second conductive strips disposed on the second layer of dielectric material, the first and second conductive strips being spaced so as to not contact each other and being disposed in a same plane;

a third layer of dielectric material disposed over the first and second conductive strips and on the second layer of dielectric material, the third layer of dielectric material having a third dielectric constant which is different from the second dielectric constant;

a patch of conductive material disposed on the third layer of dielectric material; and a probe having a central conductor and a shield, said probe mounted with its shield in contact with the conductive sheet and its central conductor extending through the conductive sheet, the first, second, and third dielectric layers to the patch of conductive material, via a space between the first and second conductive parallel strips; wherein the space between the first and second conductive parallel strips is selected to cause an impedance match to a predetermined low frequency; and wherein said probe is disposed perpendicular to the plane of the first and second conductive strips such when radiating energy is exposed to the antenna a first resonance above the first and second conductive strips and a second resonance below the first and second conductive strips result.

* * * * *